United States Patent [19]

Arai et al.

[11] Patent Number: 4,846,904

[45] Date of Patent: Jul. 11, 1989

[54] MARTENSITIC STAINLESS STEEL HAVING EXCELLENT HARDNESS BY SUBZERO TREATMENT

[75] Inventors: Hiroshi Arai; Tadahiko Murakami; Kazuo Mashimo; Jyou Tanioka, all of Sagamihara, Japan

[73] Assignee: Nippon Metal Industry Co., Ltd., Tokyo, Japan

[21] Appl. No.: 195,841

[22] Filed: May 19, 1988

[30] Foreign Application Priority Data

May 25, 1987 [JP] Japan ..... 62-125862

[51] Int. Cl.[4] ..... C22C 38/40

[52] U.S. Cl. ..... 148/325; 148/326; 148/327

[58] Field of Search ..... 420/56-61; 148/325, 326, 327

[56] References Cited

U.S. PATENT DOCUMENTS 4,450,006 5/1984 Uyehara et al. ..... 420/60

FOREIGN PATENT DOCUMENTS 38-4153 4/1963 Japan ..... 420/60
56-77369 6/1981 Japan ..... 420/56
57-123965 8/1982 Japan ..... 420/56
631556 11/1978 U.S.S.R. ..... 420/56
2073775 10/1981 United Kingdom ..... 420/60

*Primary Examiner*—Deborah Yee
*Attorney, Agent, or Firm*—Wenderoth, Lind & Ponack

[57] ABSTRACT

This invention provides the following stainless steels called invention steel 1 and invention steel 2.

Invention steel 1 is a subzero treatment hardening type martensitic stainless steel characterized by comprising not more than 0.4% by weight of C, not more than 0.4% by weight of N, not more than 15% by weight of Mn, not more than 12% by weight of Ni, 10 to 23% by weight of Cr, not more than 3.0% by weight of Mo, not more than 5.0% by weight of Cur, not more than 2.0% by weight of Si, and the remaining portion consisting of inevitable impurities and Fe and satisfying the following formaulae (1), (2) and (3), $$[Cr\ \%]+1.5[Si\ \%]+[Mo\ \%]-[Mn\ \%)]-1.3[Ni\ \%]-[Cu\ \%]-19\ [C\ \%]-19[N\ \%]\leqq 12.0 \quad \text{Formula (1)}$$

$$27.5\leqq[Cr\ \%]+1.3[SDi\ \%]+1.3[Mn\ \%]+1.5[Ni\ \%]+[Cu\ \%]+[Mo\ \%]+15[C\ \%]+20[N\ \%]\leqq 32.0 \quad \text{Formula (2)}$$

and $$1.3[Ni\ \%]+[Mn\ \%]+[Cu\ \%]>4.0 \quad \text{Formula (3)}$$

Invention steel is a subzero treatment hardening type martensitic stainless characterized by comprising not more than 0.4% by weight of C, not more than 0.4% by weight of Mn, not more than 3.0% by weight of Ni, 10 to 23% by weight of Cr, not more than 3.0% by weight of Mo, not more than 2.0% by weight of Cu, not more than 2.0% by weight of Si and the remaining portion consisting of inevitable impurities and Fe and satisfying the above formulae (1) and (2), and the following formula (4), $$1.3[Ni\ \%]+[Mn\ \%]+[Cu\ \%]\leqq 4.0 \quad \text{Formula (4)}$$

8 Claims, No Drawings

MARTENSITIC STAINLESS STEEL HAVING EXCELLENT HARDNESS BY SUBZERO TREATMENT

FIELD OF THE INVENTION

This invention relates to a martensitic stainless steel which remarkably hardens by subzero treatment at not higher than −40° C.

DESCRIPTION OF THE PRIOR ART

Generally known are stainless steels which give high hardness e.g., SUS 410 type, 420 type and 440 type martensitic stainless steels, SUS 630 type and 631 type precipitation hardening type stainless steels, SUS 201 and 301 type work hardening type stainless steels, etc.

However, in carrying out the hardening treatment of these stainless steels, all of them have to be subjected to special treatments such as hardening from temperatures of not lower than 800° C., age hardening treatment at not lower than 300° C., cold working by rolling or cold forging, etc., and the like.

Thus, these stainless steels have not yet met with consumer's demand that the steels should be soft and weldable at the time of formation working and thereafter easily hardenable.

SUMMARY OF THE INVENTION

It is an object of this invention to provide stainless steels which are sufficiently soft for plastic working and weldable, and have necessary and sufficient high hardness by subzero treatment at not higher than −40° C.

This invention provides the following invention steel 1 and invention steel 2.

Invention steel 1 is a subzero treatment hardening type martensitic stainless steel characterized by comprising not more than 0.4% by weight of C, not more than 0.4% by weight of N, not more than 15% by weight of Mn, not more than 12% by weight of Ni, 10 to 23% by weight of Cr, not more than 3.0% by weight of Mo, not more than 5.0% by weight of Cu, not more than 2.0% by weight of Si, and the remaining portion consisting of inevitable impurities and Fe and satisfying the following formulae (1), (2) and (3), Formula (1)

$$[Cr\%]+1.5[Si\%]+[Mo\%]-[Mn\%]-1.3[Ni\%]-[Cu\%]-19[C\%]-19[N\%]\leqq 12.0$$

Formula (2)

$$27.5\leqq[Cr\%]+1.3[Si\%]+1.3[Mn\%]+1.5[Ni\%]+[Cu\%]+[Mo\%]+15[C\%]+20[N\%]\leqq 32.0 \text{ and}$$

Formula (3)

$$1.3[Ni\%]+[Mn\%]+[Cu\%]>4.0$$

Invention steel 2 is a subzero treatment hardening type martensitic stainless steel characterized by comprising not more than 0.4% by weight of C, not more than 0.4% by weight of Mn, not more than 3.0% by weight of Ni, 10 to 23% by weight of Cr, not more than 3.0% by weight of Mo, not more than 2.0% by weight of Cu, not more than 2.0% by weight of Si and the remaining portion consisting of inevitable impurities and Fe and satisfying the following formulae (1), (2) and (4), Formula (1)

$$[Cr\%]+1.5[Si\%]+[Mo\%]-[Mn\%]-1.3[Ni\%]-[Cu\%]-19[C\%]-19[N\%]\leqq 12.0$$

Formula (2)

$$27.5\leqq[Cr\%]+1.3[Si\%]+1.3[Mn\%]+1.5[Ni\%]+[Cu\%]+[Mo\%]+15[C\%]+20[N\%]\leqq 32.0 \text{ and}$$

Formula (4)

$$1.3[Ni\%]+[Mn\%]+[Cu\%]\leqq 4.0$$

DETAILED DESCRIPTION OF THE INVENTION

The reasons for incorporation of the above constituent elements and the limitations of their contents are explained below.

(1) Cr: The present invention requires incorporation of more than 10% by weight of Cr to maintain the corrosion resistance of the general stainless steels. As the Cr content increases, the corrosion resistance improves. Since, however, Cr is a ferrite-forming element, it is difficult to maintain the complete austenite phase at an ordinary temperature for solution heat treatment (950° to 1180° C.). Hence, the Cr content is limited to not more than 23% by weight.

(2) C and N: It is preferable to incorporate not less than 0.2% by weight of these elements in total in order to obtain a hard martensitic phase by subzero treatment. In some applications, however, in which tenacity is weighed more than hardness, the C and N contents in total may be less than 0.2% by weight.

The incorporation of a large amount of C makes it impossible to form a complete solid solution of it in an austenite phase, and results in the formation of carbide. If the temperature in solution heat treatment is elevated further, a solid solution thereof is formed, however, if the temperature in solution heat treatment is unnecessarily high, the resultant crystalline particles are coarse. Thus, the large amount of C here has no special advantages to discuss. For these reasons, the C content should be not more than 0.4% by weight. And the incorporation of a large amount of N at the stage of dissolution, ingot-making etc., gives rise to blowholes. Hence, the N content should be limited to not more than 0.4% by weight.

(3) Mn: This element, following C, N and Ni, is incorporated in order to stabilize the austenite phase and to lower the temperature at which the martensite transformation of steels is started (Ms point). Mn is also inexpensive. Therefore, Mn may be added in an amount of up to 15% by weight at maximum in the case of invention steel 1.

However, if a large amount of Mn is added, the $Ac_1$ transformation point goes down below 700° C. and the matrix phase cannot be processed in the ferrite state at the time of cold rolling, etc., or the cold rolling, etc., have to be carried out in the austenite state. In this case, the cold rolling, etc., bring a martensite induced by the cold rolling, etc., and the resultant steel is excessively hard. In some cases, it is necessary to repeat solution heat treatment and cold rolling, etc. The disadvantages here may be avoided by decreasing the Mn content and setting the $Ac_1$ transformation point at a temperature of not lower than 700° C.

The invention steel 2 is one in which the matrix phase is in the ferrite state, and therefore, the cold rolling thereof can be carried out. For this reason, the Mn content should be limited to not more than 4% by weight.

(4) Ni: Ni, like Mn, is also a component to stabilize the austenite phase and to lower the Ms point. Since, however, this element is more expensive than Mn, and if Mn can be substituted therefor, Ni does not have to be incorporated. Since, however, in the case of using Ni, the hardness of the austenite phase by solution heat treatment characteristically lowers as compared with that of Mn type, it is possible to incorporate up to 12% by weight of Ni at the maximum for the invention steel 1.

In the case of the invention steel 2, however, the Ni content should be limited to not more than 3% by weight so as not to lower the $Ac_1$ transformation point, since the cold rolling thereof has to be carried out in the ferrite state at the production time.

(5) Cu: Cu is an element to improve the corrosion resistance and is related to the properties of the invention steels. However, the incorporation of a large amount thereof makes it difficult to form its complete solid solution in the austenite phase and impairs the hot rolling property of the resultant steels. Hence, the Cu content in the invention steel 1 is limited to not more than 5% by weight. The Cu content in the invention steel 2 should be limited to not more than 2% by weight such that the cold rolling can be carried out at the production step.

(6) Si: This element has a relation to the properties of the invention steels, however, it does not have any active role. Facilitation of the production being considered also, the Si content should be limited to not more than 2% by weight.

(7) Mo: Mo is an effective element to improve the corrosion resistance as well as Cr, and related to the properties of the invention steels. Since, however, Mo is expensive, the Mo content should be limited to not more than 3% by weight.

(8) In addition to the foregoing limitations, in the invention steels, it is necessary to obtain a nearly complete austenite phase at ordinary temperatures of solution heat treatment (950° to 1,180° C.). For this reason, the correlation among the above constituent elements are adjusted in the ranges mentioned above so as to satisfy the following formula (1).

$$[Cr\%]+1.5[Si\%]+[Mo\%]-[Mn\%]-1.3[Ni\%]-[Cu\%]-19[C\%]-19[N\%]\leqq 12.0$$

Further, the invention steel 1 is also required to satisfy the following formula (3)

$$1.3[Ni\%]+[Mn\%]+[Cu\%]>4.0$$

(9) Moreover, the invention steels are in the austenite phase or partial martensite phase-containing austenite phase, and it is required to increase martensite of the invention steels to a great extent and harden them by subzero heat treatment at not higher than −40° C. In order to achieve these requirements, the experimental results show that the correlation among the constituents elements has to be adjusted so as to satisfy the following formula (2).

$$27.5\leqq[Cr\%]+1.3[Si\%]+1.3[Mn\%]+1.5[Ni\%]+[Cu\%]+[Mo\%]+15[C\%]+20[N\%]\leqq 32.0$$

(10) Further, the prerequisite for the invention steel 2 is that the cold rolling in the production thereof should be carried out in the ferrite phase and carbide and nitride state. And if the $Ac_1$ transformation point is lowered, the result is that the means for achievement of the prerequisite is lost. Therefore, the correlation among the constituent elements is adjusted so as to satisfy the following formula (4).

$$1.3[Ni\%]+[Mn\%]+[Cu\%]\leqq 4.0$$

The steels of this invention are sufficiently soft to carry out the plastic working and weldable before the formation working and can give necessary high hardness by subzero treatment at not higher than −40° C. Therefore, they not only obviate heat treatment or oxidation prevention, acid washing and polishing which are required due to heat treatment, but also permit the hardening treatment after composite formation with other part(s). Thus, the steels of this invention make it possible to expand the applications of stainless steels to a great extent.

Especially, they are quite suitable to the conventional application in which a hardened and annealed carbon steel is subjected to the plating treatment.

The following are application examples.

Application 1

In paper holders in office work, e.g., double clip, etc., a formed carbon steel is hardened and annealed to maintain its spring property and thereafter, nickel or black lacquer is plated thereon to maintain its corrosion resistance. In this application, it is best to use a stainless steel having high corrosion resistance, however, the hardening treatment of such stainless steel requires high costs at present and the use thereof is not economical. The steels of this invention can give stainless steel clips which are less expensive costwise than those of plated carbon steel.

Application 2

Parts such as threaded washer, C-shaped retaining ring, E-shaped retaining ring, leaf nut, etc., which are to have spring property, are presently produced by shaping a carbon steel, then hardening and annealing the shaped part and subjecting the part to the plating treatment depending upon its purpose. This invention can provide spring property-possessing parts having excellent corrosion resistance.

Application 3

It is desired that materials for connector pins used in connection of electronic circuits have sufficient strength and spring property such that the connector pins can secure the firm connection and can be inserted and extracted repeatedly. However, they are, in general, very small in size and often used by plating gold thereon in order to stabilize the conductivity. In such a case, if a material is formed into a final shape and then heated at a high temperature, it is necessary to take a step against deformation and/or oxidation of the shaped material. According to the steels of this invention, the hardening can be carried out without impairing a plating layer.

Application 4

In the production of decolative laminated sheets, printing boards for electronic circuits, etc., there are used spread sheets of stainless steel having high hardness, the surface of which is uniformly polished. With regard to these spread sheets of stainless steel, there is a severe demand to flatness, and it is very difficult for these sheets to meet with both the high hardness and good flatness.

However, the use of the steels of this invention permits the remedy work to give the sufficient flatness in the sufficiently soft state before subzero hardening treatment and the subsequent hardening treatment. Therefore, it is possible to produce sheets having both the high hardness and good flatness.

Application 5

Street curve mirrors of stainless steel are used more frequently than those of glass, since stainless steel mirrors are not broken to pieces by stones thrown at them, automobile tire-snapped stones, etc. However, they have a defect of being liable to cave in. Since the steels of this invention can be remarkably hardened after the shaping work, the use thereof can permit the production of curved mirrors having an intermediate quality between the above mentioned two materials.

As mentioned above, this invention broadens the use of stainless steels to a great extent.

EXAMPLE

Steel ingots (2 kg/ingot) melt-produced in an open type high frequency melting furnace having a capacity of 5 kg of steel ingot were respectively hot rolled at 800° to 1200° C. into sheets having a thickness of 2 mm. These sheets were subjected to solution heat treatment respectively at 1,050° C. for 15 minutes, at 1,100° C. for 2 hours and 1,200° C. for 4 hours to prepare pre-subzero (treatment samples. Vickers hardness of each of the samples was measured at a pressure load of 1 kg, and the samples were cooled to −196° C. by liquid nitrogen and maintained at this temperature for 16 hours. Then, the samples were taken out and their Vickers hardness were measured at the same pressure.

The results are shown in Tables 1 to 3. Table 1 is concerned with the invention steel 1 (Cr-Mn type), Table 2 with the invention steel 1 (Cr-Ni type) and Table 3 with the invention steel 2 (Cr type). The hardening degrees were evaluated by dividing Vickers hardness values after the subzero treatment by Vickers hardness values before the subzero treatment. And in Tables 1 to 3, calculated $K_1$ by formula (1) and calculated $K_2$ by formula (2) are shown, and the invention steels are shown by A and comparative steels by B. Further, Table 4 shows hardening degrees of typical commercial steels after subzero treatment. Of these invention steels, comparative steels and commercial steels, all the steels having hardening degrees exceeding 1.3 come under the compositions of this invention.

TABLE 1

Invention steel 1 (Cr—Mn type) and comparative steel (unit: percent by weight)

| No. | C | Si | Mn | Ni | Cr | Mo | Cu | N |
|---|---|---|---|---|---|---|---|---|
| 1 | 0.25 | 2.22 | 6.63 | — | 15.93 | — | — | 0.092 |
| 2 | 0.22 | 0.20 | 6.50 | 0.01 | 16.67 | — | — | 0.187 |
| 3 | 0.13 | 0.11 | 7.55 | 0.03 | 15.31 | — | — | 0.088 |
| 4 | 0.21 | 0.11 | 6.24 | 0.07 | 15.46 | — | — | 0.079 |
| 5 | 0.22 | 0.17 | 6.65 | 0.01 | 14.68 | — | — | 0.081 |
| 6 | 0.12 | 0.27 | 6.40 | — | 15.69 | — | — | 0.085 |
| 7 | 0.14 | 0.12 | 7.95 | 0.02 | 14,18 | — | — | 0.054 |
| 8 | 0.21 | 0.14 | 5.82 | 0.02 | 15.66 | — | — | 0.057 |
| 9 | 0.13 | 0.22 | 5.92 | 0.31 | 15.44 | — | — | 0.060 |
| 10 | 0.22 | 0.61 | 2.20 | — | 16.62 | — | — | 0.079 |

| No. | Solution heat-treatment (°C.) | $K_1$ | $K_2$ | Subzero treatment before Hv | Subzero treatment after Hv | Hardening degree | |
|---|---|---|---|---|---|---|---|
| 1 | 1050 | 6.1 | 33.0 | 265 | 265 | 1.00 | B |
| 2 | 1050 | 2.7 | 32.4 | 260 | 300 | 1.15 | B |
| 3 | 1050 | 3.7 | 29.0 | 255 | 485 | 1.90 | A |
| 4 | 1050 | 3.8 | 28.6 | 278 | 517 | 1.89 | A |
| 5 | 1050 | 2.6 | 28.5 | 270 | 530 | 1.96 | A |
| 6 | 1050 | 5.8 | 27.9 | 236 | 464 | 1.97 | A |
| 7 | 1050 | 2.7 | 27.9 | 358 | 499 | 1.39 | A |
| 8 | 1050 | 5.0 | 27.7 | 382 | 515 | 1.35 | A |
| 9 | 1050 | 5.8 | 27.0 | 435 | 494 | 1.14 | B |
| 10 | 1050 | 9.7 | 26.3 | 460 | 450 | 0.99 | B |

Note:
"—" stands for substantially zero percent since the elements were not added.

TABLE 2

Invention steel 1 (Cr—Ni type) and comparative steel (unit: percent by weight)

| No. | C | Si | Mn | Ni | Cr | Mo | Cu | N |
|---|---|---|---|---|---|---|---|---|
| 1 | 0.45 | 0.75 | 0.54 | 8.02 | 14.60 | 0.48 | 0.04 | 0.049 |
| 2 | 0.22 | 0.18 | 0.30 | 5.47 | 16.00 | — | 2.32 | 0.100 |
| 3 | 0.34 | 0.65 | 0.57 | 7.04 | 12.39 | 0.50 | 0.04 | 0.061 |
| 4 | 0.10 | 0.22 | 1.22 | 6.88 | 15.78 | — | — | 0.031 |
| 5 | 0.19 | 0.30 | 0.25 | 7.20 | 12.64 | — | 2.02 | 0.047 |
| 6 | 0.12 | 0.24 | 1.13 | 5.85 | 15.60 | — | — | 0.088 |
| 7 | 0.22 | 0.18 | 0.34 | 3.52 | 16.10 | — | 2.00 | 0.093 |
| 8 | 0.21 | 0.15 | 0.32 | 1.52 | 16.20 | — | 4.07 | 0.085 |
| 9 | 0.18 | 0.56 | 0.55 | 9.74 | 5.22 | 2.10 | 0.05 | 0.032 |
| 10 | 0.10 | 0.26 | 1.12 | 3.56 | 15.56 | — | — | 0.061 |
| 11 | 0.22 | 0.19 | 0.26 | 5.28 | 11.92 | — | 3.45 | 0.075 |
| 12 | 0.22 | 0.19 | 0.22 | 6.19 | 11.84 | — | 3.39 | 0.072 |
| 13 | 0.22 | 0.18 | 0.20 | 7.11 | 11.71 | — | 3.46 | 0.080 |
| 14 | 0.081 | 0.15 | 0.26 | 7.75 | 11.84 | — | 3.36 | 0.091 |
| 15 | 0.079 | 0.18 | 0.21 | 8.84 | 11.69 | — | 3.37 | 0.093 |
| 16 | 0.08 | 0.21 | 0.23 | 9.95 | 11.57 | — | 3.47 | 0.084 |

| No. | Solution heat treatment (°C.) | $K_1$ | $K_2$ | Subzero treatment before Hv | Subzero treatment after Hv | Hardening degree | |
|---|---|---|---|---|---|---|---|
| 1 | 1050 | −4.3 | 36.6 | 272 | 272 | 1.00 | B |
| 2 | 1050 | 0.5 | 32.4 | 205 | 210 | 1.02 | B |
| 3 | 1050 | −3.5 | 31.4 | 251 | 387 | 1.54 | A |
| 4 | 1050 | 3.5 | 30.1 | 162 | 347 | 2.14 | A |
| 5 | 1050 | −3.0 | 30.0 | 161 | 337 | 2.09 | A |
| 6 | 1050 | 3.3 | 29.7 | 190 | 379 | 1.99 | A |
| 7 | 1050 | 3.5 | 29.2 | 210 | 440 | 2.10 | A |
| 8 | 1050 | 4.5 | 28.1 | 330 | 480 | 1.45 | A |
| 9 | 1050 | −9.1 | 26.8 | 425 | 507 | 1.19 | B |
| 10 | 1050 | 8.3 | 25.4 | 449 | 478 | 1.07 | B |
| 11 | 1050 | −4.0 | 28.7 | 186 | 507 | 2.73 | A |
| 12 | 1050 | −4.9 | 29.8 | 175 | 447 | 2.42 | A |
| 13 | 1050 | −6.6 | 31.2 | 161 | 410 | 2.55 | A |
| 14 | 1050 | −4.9 | 30.4 | 165 | 407 | 2.47 | A |
| 15 | 1050 | −6.3 | 31.9 | 142 | 380 | 2.68 | A |
| 16 | 1050 | −7.9 | 33.4 | 139 | 140 | 1.00 | B |

TABLE 3

Invention steel 2 (Cr type) and comparative steel (unit: percent by weight)

| No. | C | Si | Mn | Ni | Cr | Mo | Cu | N |
|---|---|---|---|---|---|---|---|---|
| 1 | 0.23 | 0.28 | 1.51 | — | 21.1 | — | — | 0.302 |
| 2 | 0.23 | 0.28 | 1.50 | — | 18.2 | — | — | 0.146 |
| 3 | 0.31 | 0.20 | 0.20 | — | 17.61 | — | — | 0.33 |
| 4 | 0.40 | 0.20 | 0.20 | — | 17.71 | — | — | 0.20 |
| 5 | 0.23 | 0.27 | 1.51 | — | 18.3 | — | — | 0.24 |
| 6 | 0.22 | 0.27 | 1.52 | — | 19.1 | — | — | 0.197 |
| 7 | 0.20 | 0.20 | 0.20 | — | 17.81 | — | — | 0.36 |
| 8 | 0.23 | 0.30 | 1.51 | — | 19.1 | — | — | 0.148 |
| 9 | 0.23 | 0.28 | 1.50 | — | 19.9 | — | — | 0.11 |
| 10 | 0.45 | 0.28 | 0.34 | — | 16.7 | — | — | 0.11 |
| 11 | 0.26 | 0.35 | 1.66 | — | 18.34 | — | — | 0.193 |
| 12 | 0.28 | 0.30 | 1.66 | — | 19.58 | — | — | 0.133 |
| 13 | 0.25 | 0.28 | 1.70 | — | 20.16 | — | — | 0.134 |

| No. | Solution heat-treatment (°C.) | $K_1$ | $K_2$ | Subzero treatment before Hv | Subzero treatment after Hv | Hardening degree |
|---|---|---|---|---|---|---|

TABLE 3-continued

| Invention steel 2 (Cr type) and comparative steel (unit: percent by weight) | | | | | | | |
|---|---|---|---|---|---|---|---|
| 1 | 1100 | 9.9 | 32.9 | 245 | 270 | 1.10 | B |
| 2 | 1100 | 10.0 | 26.9 | 520 | 610 | 1.17 | B |
| 3 | 1100 | 5.6 | 29.4 | 290 | 570 | 1.97 | A |
| 4 | 1100 | 6.2 | 29.2 | 280 | 550 | 1.96 | A |
| 5 | 1100 | 8.3 | 28.9 | 255 | 540 | 2.12 | A |
| 6 | 1100 | 10.1 | 28.7 | 240 | 520 | 2.17 | A |
| 7 | 1100 | 7.3 | 28.5 | 400 | 590 | 1.48 | A |
| 8 | 1100 | 10.9 | 27.9 | 380 | 530 | 1.39 | A |
| 9 | 1100 | 12.4 | 27.9 | 370 | 420 | 1.14 | B |
| 10 | 1200 | 6.5 | 26.5 | 620 | 670 | 1.08 | B |
| 11 | 1100 | 8.6 | 28.8 | 301 | 586 | 1.95 | A |
| 12 | 1100 | 10.5 | 28.8 | 357 | 489 | 1.37 | A |
| 13 | 1100 | 11.6 | 29.2 | 309 | 425 | 1.38 | A |

TABLE 4

| Hardening of commercial steel by subzero treatment | | | |
|---|---|---|---|
| | Subzero treatment | | |
| No. | before Hv | after Hv | Hardening degree |
| SUS 201 | 215 | 211 | 0.98 |
| SUS 301 | 183 | 184 | 1.01 |
| SUS 304 | 164 | 165 | 1.01 |
| SUS 316 | 169 | 167 | 0.99 |
| SUS 410 | 166 | 164 | 0.99 |
| SUS 420 | 188 | 186 | 0.99 |
| SUS 430 | 158 | 158 | 1.00 |
| SUS 630 | 387 | 395 | 1.02 |
| SUS 631 | 195 | 193 | 0.99 |

What we claim is:

1. A shaped and treated martensitic stainless steel having a hardening degree of over 1.3, obtained by hot rolling or cold rolling stainless steel which comprises not more than 0.4% by weight of C, not more than 0.4% by weight of N, not more than 15% by weight of Mn, not more than 12% by weight of Ni, 10 to 23% by weight of Cr, not more than 3.0% by weight of Mo, not more than 5.0% by weight of Cu, not more than 2.0% by weight of Si and the remaining portion consisting of Fe and inevitable impurities, wherein the stainless steel composition satisfies the following formulae (1), (2) and (3)

$$[Cr\%]+1.5[Si\%]+[Mo\%]-[Mn\%]-1.3[Ni\%]-[Cu\%]-19[C\%]-19[N\%]\leqq 12.0 \quad \text{Formula (1)}$$

$$27.5\leqq[Cr\%]+1.3[Si\%]+1.3[Mn\%]+1.5[Ni\%]+[Cu\%]+[Mo\%]+15[C\%]+20[N\%]\leqq 32.0 \quad \text{Formula (2)}$$

$$1.3[Ni\%]+[Mn\%]+[Cu\%]>4.0, \quad \text{Formula (4)}$$

subjecting the stainless steel to a solution heat-treatment to obtain a treated stainless steel, processing the treated stainless steel for shaping to obtain a shaped stainless steel, and subjecting the resultant shaped stainless steel to subzero treatment at a temperature of not more than −40° C.

2. A stainless steel according to claim 1 wherein the Mn content is from more than 4.0% by weight to 15.0% by weight and the Ni content is from more than 3.0% by weight to 12.0% by weight.

3. A stainless steel according to claim 1 wherein the Mn content is from more than 4.0% by weight to 15.0% by weight and the Ni content is not more than 3.0% by weight.

4. A stainless steel according to claim 1 wherein the Mn content is not more than 4.0% by weight and the Ni content is from more than 3.0% by weight to 12.0% by weight.

5. A stainless steel according to claim 1 wherein the Mn content is not more than 4.0% by weight, the Ni content is not more than 3.0% by weight and the Cu content is from more than 2.0% by weight to 5.0% by weight.

6. A stainless steel according to claim 1 wherein the Mn content is not more than 4.0% by weight, the Ni content is from more than 3.0% by weight to 12.0% by weight and the Cu content is from more than 2.0% by weight to 5.0% by weight.

7. A stainless steel according to claim 1 wherein the Mn content is not more than 4.0% by weight, the Ni content is not more than 3.0% by weight and the Cu content is not more than 2.0% by weight.

8. A shaped and treated martensitic stainless steel having a hardening degree of over 1.3, obtained by hot rolling or cold rolling stainless steel which comprises not more than 0.4% by weight of C, not more than 0.4% by weight of N, not more than 4% by weight of Mn, not more than 3.0% by weight of Ni, 10 to 23% by weight of Cr, not more than 3.0% by weight of Mo, not more than 2.0% by weight of Cu, not more than 2.0% by weight of Si and the remaining portion consisting of Fe and inevitable impurities, wherein the stainless steel composition satisfies the following formulae (1), (2) and (4)

$$[Cr\%]+1.5[Si\%]+[Mo\%]-[Mn\%]-1.3[Ni\%]-[Cu\%]-19[C\%]-19[N\%]\leqq 12.0 \quad \text{Formula (1)}$$

$$27.5\leqq[Cr\%]+1.3[Si\%]+1.3[Mn\%]+1.5[Ni\%]+[Cu\%]+[Mo\%]+15[C\%]+20[N\%]\leqq 32.0 \quad \text{Formula (2)}$$

$$1.3[Ni\%]+[Mn\%]+[Cu\%]\leqq 4.0, \quad \text{Formula (4)}$$

subjecting the stainless steel to a solution heat-treatment to obtain a treated stainless steel, processing the treated stainless steel for shaping to obtain a shaped stainless steel, and subjecting the resultant shaped stainless steel to subzero treatment at a temperature of not more than −40° C.

* * * * *